United States Patent [19]

Lewandowski

[11] 4,147,000

[45] Apr. 3, 1979

[54] INSULATED LOG BUILDING STRUCTURE

[76] Inventor: Robert E. Lewandowski, c/o Mayfield Stage, Boise, Id. 83707

[21] Appl. No.: 846,728

[22] Filed: Oct. 31, 1977

[51] Int. Cl.[2] ..... E04B 1/10

[52] U.S. Cl. ..... 52/233; 52/425

[58] Field of Search ..... 52/227, 233, 396, 425, 52/426

[56] References Cited

U.S. PATENT DOCUMENTS

| | | | |
|---|---|---|---|
| 678,052 | 7/1901 | Slye | 52/227 |
| 1,573,029 | 2/1926 | Beardall | 52/233 |
| 2,309,426 | 1/1943 | Williams | 52/233 |
| 3,517,471 | 6/1970 | Lindmark | 52/233 |
| 4,058,947 | 11/1977 | Earle | 52/396 |

FOREIGN PATENT DOCUMENTS

| | | | |
|---|---|---|---|
| 478868 | 9/1950 | Canada | 52/233 |
| 783292 | 4/1968 | Canada | 52/233 |
| 41122 | 3/1924 | Norway | 52/233 |
| 189073 | 11/1922 | United Kingdom | 52/233 |

OTHER PUBLICATIONS

American Builder, © Feb. 1933, p. 33.

*Primary Examiner*—Ernest R. Purser
*Assistant Examiner*—Henry Raduazo
*Attorney, Agent, or Firm*—Paul F. Horton

[57] ABSTRACT

An insulated log building structure comprising two parallel, vertically extending log walls having an insulative layer of foam plastic disposed therebetween. Each of the walls are formed of horizontally extending logs mounted vertically upon one another in a tongue and groove relationship. A layer of fiberglass insulation may be disposed between the tongues and grooves of contacting logs to insulatively seal the joints. Vertically extending tie rods within vertically aligned apertures of the logs making up the walls hold the two log walls in parallel alignment.

5 Claims, 2 Drawing Figures

INSULATED LOG BUILDING STRUCTURE

BACKGROUND OF THE INVENTION

1. Field of the Invention

This invention relates, in general, to insulative walls, and in particular, to insulative log walls.

2. Description of the Prior Art

The desirability of constructing homes and other buildings of logs has long been recognized. The log cabin continue to be a symbol of our early American heritage. Houses, of log construction, are currently popular not only because of their pleasing esthetic characteristics, but also because of their acoustics, fire resistivity, and thermo-inertia. The high density of logs prevents rapid expansion of fire. The density of logs, in combination with the characteristic convex curvature results in excellent acoustical absorption both interiorly and exteriorly of the home. Logs also provide good thermo-inertia, i.e., logs have good heat retention, thereby suppressing rapid temperature fluctuation. In addition, log walls, both interior and exterior, require very little maintenance when given a proper coat of preserving fluid.

While log constructed homes have a number of advantages, a particular disadvantage is the insulative quality of homes so constructed. Log houses, in the past, have been constructed of logs having a wide cross sectional area to overcome this problem. Although providing comfortable living, such houses are more costly and more difficult to construct, and logs of small diameter are simply unuseable. Standard houses are usually insulated by placing insulation inside the framework of the wall proper. However, standard houses lack the inherent advantages of log homes, as above mentioned. Patents relevant to the problem include those of Williams and Morteson. Williams, U.S. Pat. No. 2,309,426 discloses the use of half logs attached to standard studs or frame members being filled with heat insulation material in a standard manner. Mortenson, U.S. Pat. No. 3,552,079 similarly discloses half logs and slabs. Mortenson also discloses a tongue and groove construction having insulative panels sandwiched between the half logs. Williams has the disadvantage of a standard frame construction with resultant high cost. Mortenson requires excessive woodworking, is restricted in the thickness of insulation, and is excessively expensive to construct.

SUMMARY OF THE INVENTION

The present invention comprises, generally, a pair of log walls having insulative material therebetween. The log walls are of tongue and groove construction having a layer of fiberglass insulation disposed therebetween. The insulative material is preferably blown in polyurethane. The walls may be strengthened and stabilized by use of vertical tie bars.

It is therefore an object of the present invention to provide an insulative log wall as a building element for a log home, having high acoustical absorption interiorly and exteriorly; high thermo-inertia interiorly; and which is esthetically pleasing and inexpensive.

More specifically, it is an object of the present invention to provide an insulative wall comprising double walls having an insulative layer therebetween.

Even more specifically, it is an object of the present invention to provide a double log wall of tongue and groove construction having a layer of low thermal conductivity material therebetween.

It is a further object of the present invention to provide an insulative log wall of tongue and groove construction having an insulative sealer between tongues and grooves.

A still further object of the present invention is to provide an insulative log wall having vertical tie bars.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
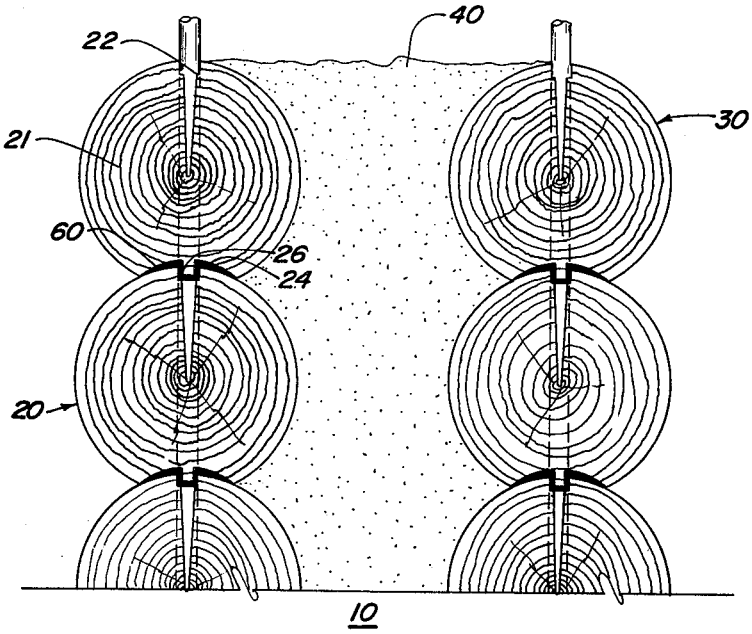
FIG. 1 is a cross sectional view of a preferred embodiment of the insulative wall of the present invention.
Figure 2:
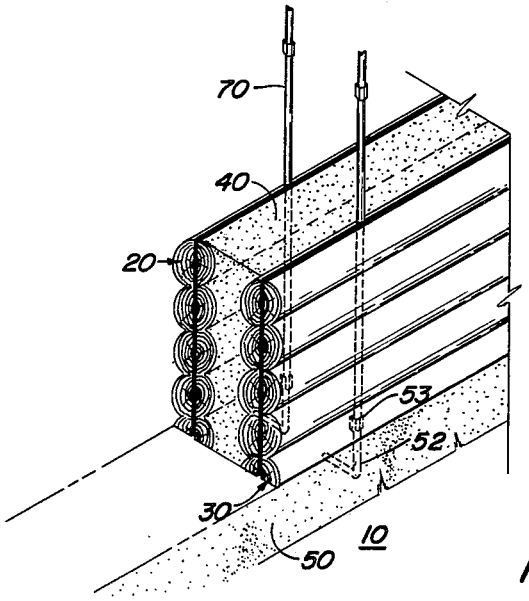
FIG. 2 is a perspective view of a log wall of the present invention.

Referring now to the drawings, an embodiment to be preferred of the insulative log building structure made according to the present invention is disclosed. The log building structure of the present invention includes a first wall 20; a second wall 30; and an insulative layer 40 located therebetween. First wall 20 and second wall 30 are identical in construction and therefore a description of one wall shall suffice. The logs used in the invention are usually soft wood logs such as pine. All logs used are previously cured and rounded so that a non-warping log of uniform diameter is obtained. It is an important element of the present invention that logs having such a small diameter that they are usually not useable for log houses because of their poor insulative qualities, are capable of being used in the construction. Choice of diameter of the logs used, therefore, is largely discretional. For endurance and stability, it is recommended that a concrete foundation 50 be used for placement of the logs, as shown in FIG. 2. Each individual log, as typified by log 21 of FIG. 1, has cut into it a curing curf so that the log will cure at a substantially uniform rate, thereby preventing checks in the wood. The curf is a straight cut going from the periphery of the log to the center of the log, as shown. After curing the log is shaved so that a near perfect log of uniform diameter is obtained. A groove 22 is then cut longitudinally in the log at the point of the curf, on the upper portion of the log. On the opposite side of the log, designated as the lower portion, a longitudinally concave groove 24 is cut, leaving an outwardly extending tongue having a configuration and size smaller than that of groove 22.

In constructing the wall, one log is placed horizontally on the concrete foundation 50 with groove 22 upwardly oriented. A strip of fiberglass insulation, used as a sealer, sufficient to cover the contacting surfaces of the logs, is then placed in groove 22 and a second log, having its tongue portion down, is placed vertically over the first log, with the tongue 26 of the upper log fitting snugly into the groove of the lower log. Fiberglass sealer 60 is thereby crushed between the logs, providing a water-tight insulative sealer between the logs. Logs 21 are held in vertical alignment by means of the tongue and grooves; by means of the overlapping engagement on the corners, and also by means of vertical tie rods 70, shown to advantage in FIG. 2. When using tie rods 70, logs 21 are drilled substantially in alignment with the curf and the tongue and grooves so that vertically aligned apertures are provided for insertion of tie rod 70. Tie rod 70, in preferred embodiment, is attached to foundation 50 by means of concrete bolt 52 and coupler 53. After both walls are constructed, in the manner as described for the first wall, above, and after the tie rods 70 have been installed, a foam plastic insulation 40 is blown into the space between the walls thereby providing a moisture proof insulative barrier. Polyurethane insulative material is used in the preferred embodiment. It is to be noted, that varying thickness of insulative material 40 may be used, depending upon the size of logs used and normal weather conditions in a particular area.

Having thus described in detail, a preferred embodiment of the present invention, it is to be appreciated and will be apparent to those skilled in the art that many physical changes could be made in the apparatus without altering the invention concepts and principles embodied therein. The present embodiment is therefore to be considered in all respects as illustrative and not restrictive, the scope of the invention being indicated by the appended claims rather than the forgoing description, and all changes which come within the meaning and range of equivalency of the claims are therefore to be embraced therein.

I claim:

1. An insulative log building structure comprising:

a plurality of horizontally extending cylindrical logs of substantially uniform diameter mounted vertically upon one another forming a first wall;

a plurality of horizontally extending cylindrical logs of substantially uniform diameter mounted vertically upon one another forming a second wall, each of said logs forming said walls including an upper portion, convexly curved in cross section and provided with a longitudinally extending groove and a lower portion having a longitudinally concavely curved groove and having a longitudinally extending tongue outwardly extending from substantially the center of said groove, said groove of the upper portion of each log mateably receiving the tongue of an overlying log;

a layer of insulating material contained between said first and second walls, said material having a lower thermal conductivity than the walls;

at least one tie rod, vertically extending through centrally aligned apertures of each log of each wall from the lowermost log to the uppermost log of each wall; and tie rod holding means for holding tie rods of each wall in a vertically aligned relationship with one another.

2. The structure as described in claim 1, further comprising a layer of fiberglass insulation horizontally disposed between the groove of the upper portion of each log and the tongue of an overlying log to insulatively seal the mating surfaces of the logs.

3. The structures as described in claim 1, wherein said insulating material is a foam plastic material.

4. The structure as described in claim 3, wherein said insulating material is polyurethane.

5. An insulative log building structure comprising: a plurality of horizontally extending logs mounted vertically upon one another forming a first wall, each of said logs including an upper portion, convexly curved in cross-section and including a longitudinally extending groove, and a lower portion having a longitudinally concavely curved groove having a longitudinally extending tongue outwardly extending from substantially the center of the concavely curved groove, said groove of the upper portion of each log mateably receiving the tongue of an overlying log;

a plurality of logs each having a tongue and groove in the manner of the logs of said first wall, said logs being horizontally extending and mounted vertically upon one another forming a second wall, the second wall in spaced parallel relationship with the first wall;

a layer of fiberglass insulation horizontally disposed between the groove of the upper portion of each log and the tongue of an overlying log to insulatively seal the mating surfaces of the logs;

a foam plastic insulative material disposed between said first and second walls, said material having a lower thermal conductivity than said walls;

a plurality of tie rods, vertically extending through centrally cut vertically aligned apertures in each log of each wall; and tie rod holding means operable to hold tie rods of the first wall in vertically aligned relationship with the tie rods of the second wall.

* * * * *